US007079126B1

(12) United States Patent
Correa et al.

(10) Patent No.: US 7,079,126 B1
(45) Date of Patent: Jul. 18, 2006

(54) METHOD FOR POWER LEVEL CONTROL OF A DISPLAY DEVICE AND APPARATUS FOR CARRYING OUT THE METHOD

(75) Inventors: Carlos Correa, Villingen-Schwenningen (DE); Sébastien Weitbruch, Mönchweiler (DE); Rainer Zwing, Villingen-Schwenningen (DE)

(73) Assignee: Thomson Licensing, Boulogne-Billancourt (FR)

( * ) Notice: Subject to any disclaimer, the term of this patent is extended or adjusted under 35 U.S.C. 154(b) by 299 days.

(21) Appl. No.: 10/089,507

(22) PCT Filed: Jul. 31, 2000

(86) PCT No.: PCT/EP00/07395

§ 371 (c)(1),
(2), (4) Date: Mar. 28, 2002

(87) PCT Pub. No.: WO01/24150

PCT Pub. Date: Apr. 5, 2001

(30) Foreign Application Priority Data

Sep. 30, 1999 (EP) ..... 99250347

(51) Int. Cl.
*G09G 5/00* (2006.01)

(52) U.S. Cl. ..... 345/212; 345/211; 345/60; 345/41

(58) Field of Classification Search ..... 345/41, 345/42, 60–63, 101, 211, 212
See application file for complete search history.

(56) References Cited

FOREIGN PATENT DOCUMENTS

| | | | |
|---|---|---|---|
| EP | 888 004 | A2 | 12/1998 |
| EP | 0888004 | A2 | 12/1998 |
| EP | 924 683 | A2 | 6/1999 |
| JP | 11-194745 | A | 7/1999 |

*Primary Examiner*—Sumati Lefkowitz
*Assistant Examiner*—Srilakshmi K Kumar
(74) *Attorney, Agent, or Firm*—Joseph J. Laks; Harvey D. Fried; Sammy S. Henig

(57) ABSTRACT

Plasma Display Panels are becoming more and more interesting for TV technology. One important criterion for picture quality is the Peak White Enhancement Factor PWEF. In a previous patent application a method for power level control in a display with which the PWEF can be increased has been proposed. With an increased PWEF the problem of local overheating of plasma cells may occur. This invention proposes a protection circuit, which deals with this problem. For protecting the plasma display against local overheating, there is provided a method, which performs the steps of local power value determination, local temperature estimation, maximum local temperature determination and maximum power level limit determination. The power level limit influences the power level control process in the display device so that local overheating is avoided and the highest possible PWEF can be used. The invention also concerns a corresponding apparatus for carrying out the proposed method.

8 Claims, 5 Drawing Sheets

METHOD FOR POWER LEVEL CONTROL OF A DISPLAY DEVICE AND APPARATUS FOR CARRYING OUT THE METHOD

This application claims the benefit under 35 U.S.C. § 365 of International Application PCT/EP00/07395, filed Jul. 31, 2000, which claims the benefit of European Application No. 99250347.4, filed Sep. 30, 1999.

The invention relates to a method for power level control of a display device and an apparatus for carrying out the method.

More specifically the invention is closely related to a kind of video processing for improving the picture quality of pictures which are displayed on displays like plasma display panels (PDP), and all kind of displays based on the principle of duty cycle modulation (pulse width modulation) of light emission/reflection/transmission. Specific claim is laid on the aspect of panel temperature estimation for power level control.

BACKGROUND

For image quality, peak white is of paramount importance. The Peak White Enhancement Factor (PWEF) can be defined as the ratio between the peak white luminance, to the luminance of a homogeneous white field, usually referred to as the full white level. CRT based displays have PWEFs of up to 5, first generation of PDPs were characterised by having a peak white to maximum average luminance ratio of about 2. This is far worse than what is achieved in old CRT technology.

A Plasma Display Panel (PDP) utilizes a matrix array of discharge cells, which could only be "ON" or "OFF". Also unlike a CRT or LCD in which grey levels are expressed by analogue control of the light emission, a PDP controls the grey level by modulating the number of light pulses per frame (sustain pulses). The eye will integrate this time-modulation over a period corresponding to the eye time response.

More sustain pulses correspond to higher peak luminance values. More sustain pulses correspond also to a higher power that flows in the PDP. The PDP control can generate more or less sustain pulses as a function of average picture power, i.e., it switches between modes with different power levels. In this document, the Power Level of a given mode is defined as the number of sustain discharges activated for a region of 100 ire video. The available range of power level modes is regarded as approximately equal to the PWEF.

A previous European patent application of the applicant with application number 99101977.9 reports a technique that increases the PWEF of a PDP by increasing the number of available power level modes, in number and in range, and by introducing an hysteresis circuit in the luminance level selection control. This technique allows achieving PWEF values up to 5.

PDPs have a large surface. A PWEF of 5, although pleasant to the image quality, has the disadvantage that it may concentrate, under certain circumstances, for a long time, the power dissipation on a small surface of the panel. If this situation is prolonged for a long time, which may occur in case of still video, local overheating of the panel may assume unacceptable values.

It has been proposed in WO 99/30309 to provide a panel temperature detector beside an average picture level detector and a picture peak level detector in a PDP for the purpose of power level control.

INVENTION

The present invention has the object to further improve the power level control of displays, like PDPs. This object is achieved with the measures of claim 1. According to the invention a local temperature estimator is used instead of a simple temperature detector for power level control.

This has the advantage, that also in case of still pictures, in which only small areas have high luminance values, the panel can be reliably protected against local thermal overheating by switching over to lower power level modes.

This proposal can be used in combination with any peak white enhancement circuit providing a large PWEF factor, not only for PDPs.

In other words, one main idea behind this invention is to try to build a model that describes local overheating of a panel as a function of the displayed video picture, and to use that information to control the operation of the peak white enhancement loop.

The invention also concerns an advantageous apparatus for carrying out the method according to the invention. This apparatus contains practically speaking a thermal protection circuit for displays having a large PWEF, and comprises the following components:

1. A local power level determination unit.
2. A local temperature estimation unit.
3. A maximum local temperature determination unit.
4. A selector of the maximum allowed power level mode, as a function of the estimated maximum local temperature value. This function should include hysteresis, in order to prevent the occurrence of perceivable luminance oscillations.
5. A limiter of the current power level value, to the selected maximum allowed power level. This limiter actually performs the protection function because it determines the sub-field organisation and sustain pulse generation which corresponds to the determination of the flow of energy into the PDP.

Advantageous additional embodiments to the claimed power level control method and apparatus are apparent from the dependent claims.

DRAWINGS

Exemplary embodiments of the invention are illustrated in the drawings and are explained in more detail in the following description.

EXEMPLARY EMBODIMENTS

The principles behind this invention are now explained by means of an example. It is strongly noted that values in an actual implementation may differ from those here shown, in particular the number and weight of the used sub-fields and the number of actual sustain pulses.

Figure 1:
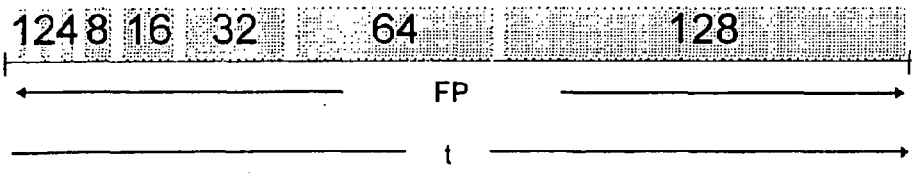
FIG. 1 shows an illustration for explaining the sub-field concept of a PDP.

In the field of video processing is an 8-bit representation of a luminance level very common. In this case each video level will be represented by a combination of the following 8 bits:

$\mathbf{2}^0=1$, $\mathbf{2}^1=2$, $\mathbf{2}^2=4$, $\mathbf{2}^3=8$, $\mathbf{2}^4=16$, $\mathbf{2}^5=32$, $\mathbf{2}^6=64$, $\mathbf{2}^7=128$ To realise such a coding scheme with the PDP technology, the frame period will be divided in 8 sub-periods which are also very often referred to sub-fields, each one corresponding to one of the 8 bits. The duration of the light emission for the bit $\mathbf{2}^1=2$ is the double of that for the bit $\mathbf{2}^0=1$ etc. With a combination of these 8 sub-periods, we are able to build 256 different grey levels. E.g. the grey level 92 will thus have the corresponding digital code word %1011100. It should be appreciated, that in PDP technology the sub-fields consist each of a corresponding number of small pulses with equal amplitude and equal duration. Without motion, the eye of the observer will integrate over about a frame period all the sub-periods and will have the impression of the right grey level. The above-mentioned sub-field organisation is shown in FIG. 1. Note that FIG. 1 is simplified in that respect that the time periods for addressing the plasma cells and for erasing the plasma cells after addressing (scanning) and sustaining are not explicitly shown. However, they are present for each sub-field in plasma display technology which is well known to the skilled man in this field. These time periods are mandatory and can be constant for each sub-field.

When all sub-fields are activated, the lighting phase has a relative duration of 255 relative time units. The value of 255 has been selected in order to be able to continue using the above-mentioned 8-bit representation of the luminance level or RGB data which is being used for PDPs. The second sub-field in FIG. 1 has e.g. a duration of 2 relative time units. In the field of PDP technology, the relative duration of a sub-field is often referred to the 'weight' of a sub-field, the expression will also be used hereinafter.

An efficient peak white enhancement control circuit requires a high number of discrete power level modes for mapping the 8 bit words of video signal level (RGB-, YUV-signals) to respective sub-field code words. Switching is done between the different power level modes as e.g. described in the European Patent Application 99101977.9 of the applicant. For the disclosure of the invention it is therefore also referred to the content of this application.

Figure 2:
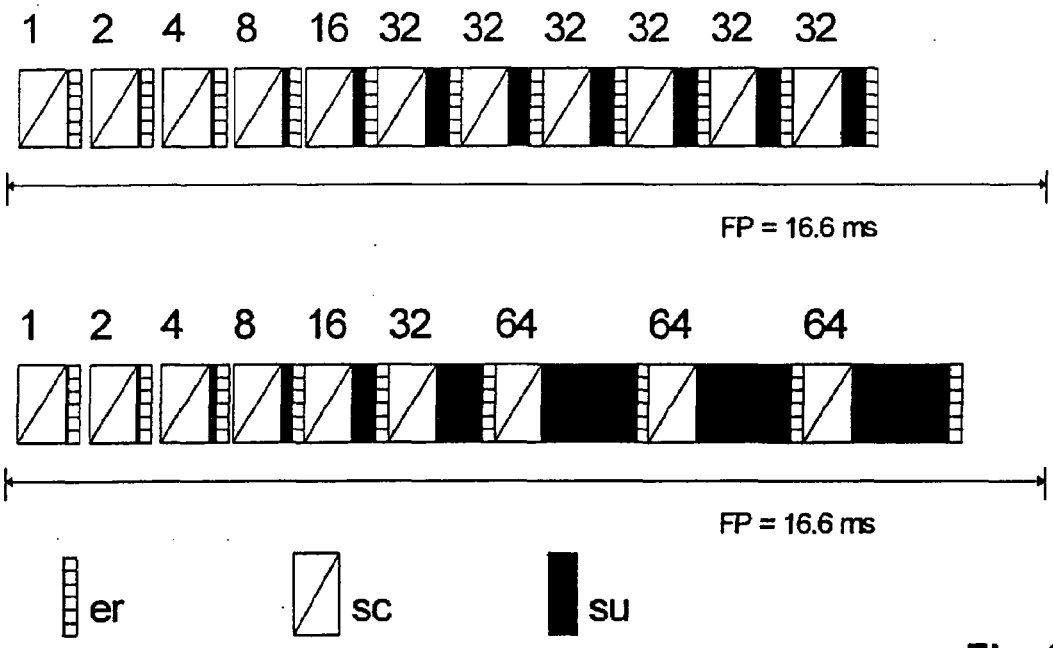
FIG. 2 shows two different sub-field organisations to illustrate the concept of switching between different power level modes for peak white enhancement.

In FIG. 2 it is briefly shown how the principle of dynamic sub-field organisation works. Two modes with different power levels are shown.

In the first mode the sub-field organisation is composed of 11 sub-fields SF and in the second mode it is composed of 9 sub-fields. Each sub-field SF consists of an addressing period sc (scan period) where each plasma cell is charged or not charged determined by the code word for each pixel, a sustain period su where the pre-charged plasma cells are activated for light emission and an erase period er, where the plasma cells are discharged. In the 9 sub-field case, less time is required for addressing (scan), and therefore more time is available for sustain pulses (the area in black is larger). The erase and scan time of a sub-field is independent of the corresponding sub-field weight. It can be seen from the figure, that the sub-field position and the sub-field weight is different for the two shown cases. For instance in the first shown case, the weight of the seventh sub-field is 32, and in the second case, the weight of the seventh sub-field is 64. The depicted relative time duration for addressing, erasing and sustain times are only exemplary and may be different in certain implementations. Also it's not mandatory, that the sub-fields with low weights are positioned at the beginning and the sub-fields with higher weights are positioned at the end of the field/frame period.

Supposed is a PDP device with a PWEF of 5. Video is coded from 0 to 255. Power level control generates a maximum of 5*255 sustain pulses (peak white) and a minimum of 255 pulses (full white), for 100 ire, in the mode with lower power level.

A solution was described using 4 different main modes:

Mode 1: 12 sub-fields (2*255 sustain pulses):
1-2-4-8-16-32-32-32-32-32-32-32

Mode 2: 11 sub-fields (3*255 sustain pulses):
1-2-4-8-16-32-32-40-40-40-40

Mode 3: 10 sub-fields (4*255 sustain pulses):
1-2-4-8-16-32-48-48-48-48

Mode 4: 9 sub-fields (5*255 sustain pulses):
1-2-4-8-16-32-64-64-64

Each of these 4 modes is subdivided in about 16 sub-modes, which use the same number of sub-fields, but which encode 100 ire to a different value (dynamic pre-scaling). A total of 67 sub-modes were listed, corresponding to 67 power levels (number of sustain pulses for 100 ire), increasing gradually from 255 to 1275.

Figure 3:
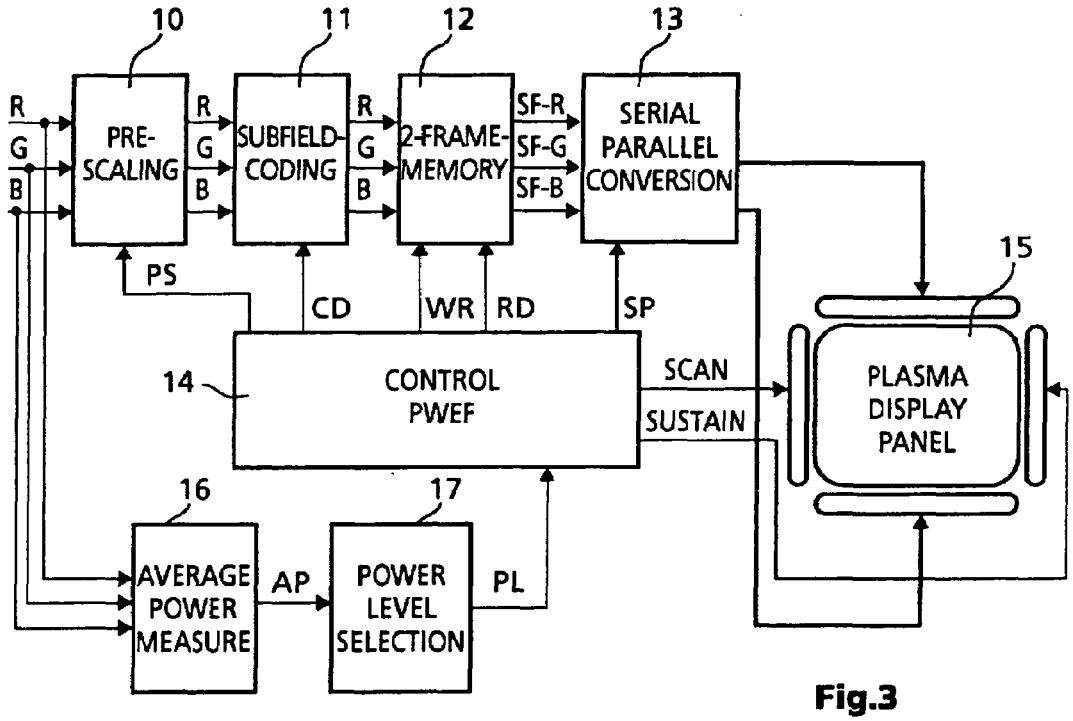
FIG. 3 shows a block diagram of a plasma display apparatus inclusive power level control apparatus such as known from EP 99101977.9.

The peak white enhancement circuit as disclosed in EP 99101977.9 is shown in FIG. 3.

RGB data is analysed in the average power measure block which gives the computed average power value (AP) for the whole picture to the PWEF control block. The PWEF control block, consults its internal power level mode table, taking into consideration the previous measured average power value and the stored hysteresis curve, and directly generates the selected mode control signals for the other processing blocks. It selects the pre-scaling factor (PS) and the sub-field coding parameters (CD) to be used. These are e.g. number of sub-fields, positioning of the sub-fields, sub-field weights and sub-field types. It also controls the writing of RGB pixel data in the frame memory (WR), the reading of RGB sub-field data from the second frame memory (RD), and the serial to parallel conversion circuit (SP) for addressing of lines. Finally it generates the SCAN and SUSTAIN pulses required to drive the PDP driver circuits.

Figure 4:
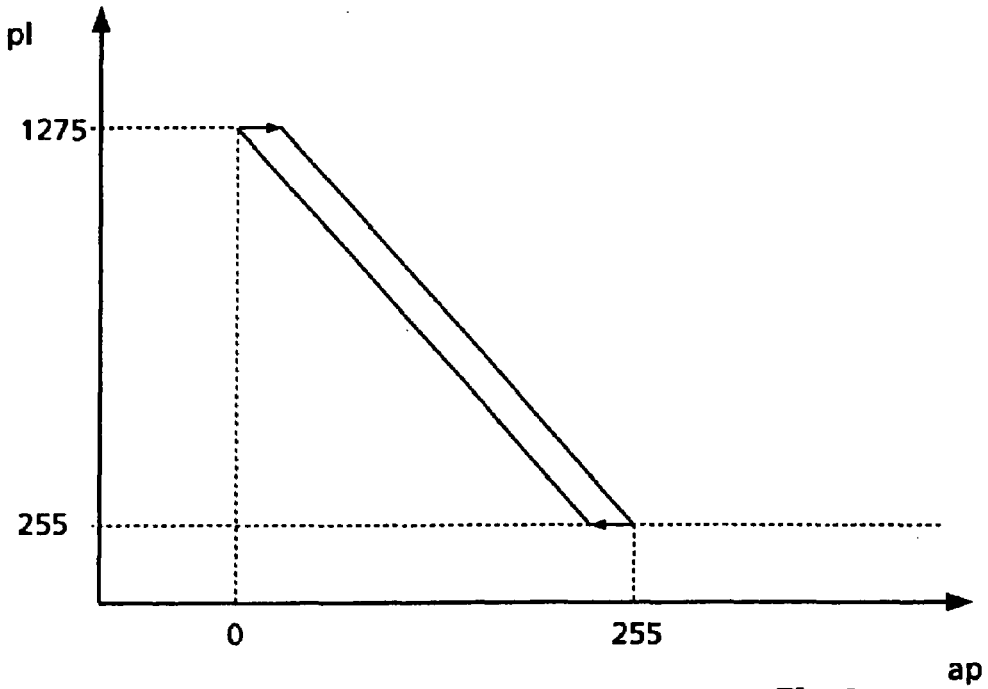
FIG. 4 shows a hysteresis curve used for power level selection in the apparatus shown in FIG. 1.

FIG. 4, also already shown in patent application EP 99101977.9, shows a possibility for the dynamic control of the power level selection (pl) as a function of the measured picture average power (ap).

As it should be expected, when picture power level increases, modes are selected with decreasing power levels. There is an hysteresis loop in the control function. When picture average power is increasing, modes with power levels on the top line are chosen. When picture power is decreasing, modes with power levels on the bottom line are chosen. Points between the two lines can be chosen when the picture average power growth direction is modified. With this power level control method the power supply of a PDP is protected. An overload of the power supply in case of pictures with high average picture power values is avoided. On the other hand in case of low average picture power values more sustain pulses are produced and the power supply can provide the required current without being overloaded.

Figure 5:
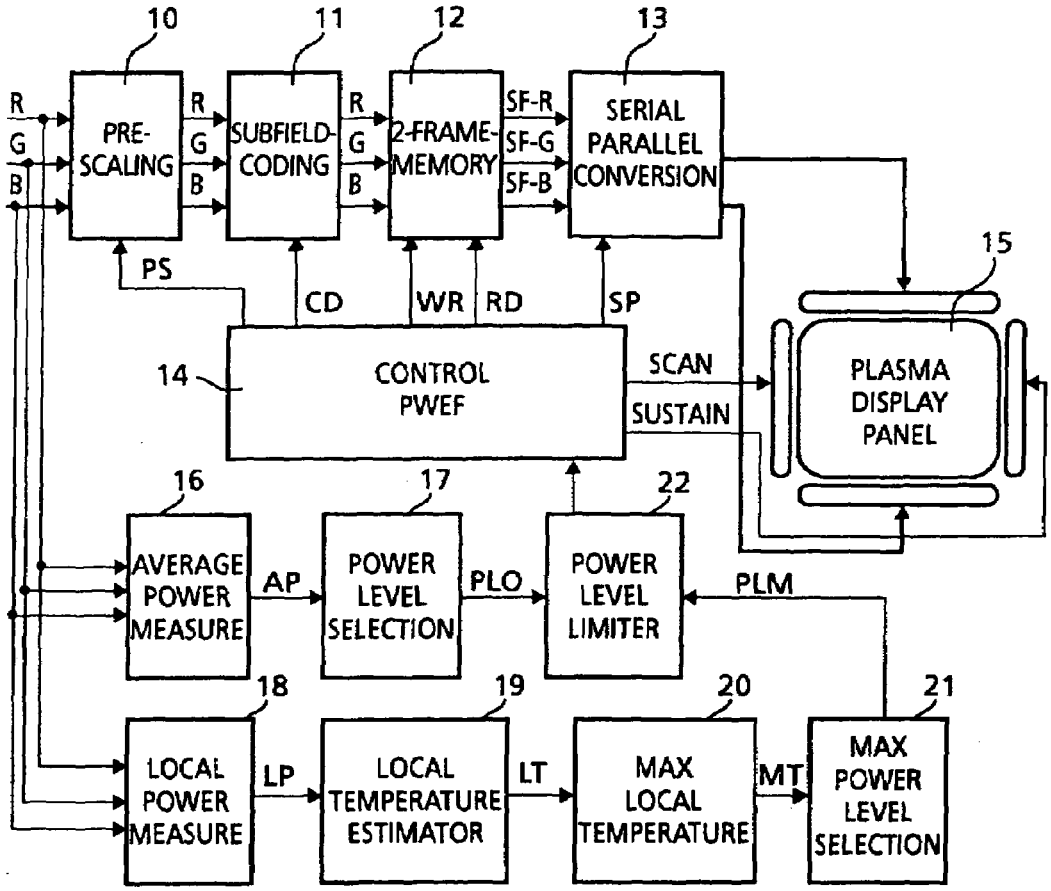
FIG. 5 shows a block diagram of a plasma display apparatus inclusive power level control apparatus according to the invention.

FIG. 5 depicts a peak white enhancement circuit with a thermal protection circuit for the PDP, which is the core of this invention. The blocks drawn in bold correspond to the blocks that constitute the protection circuit.

This protection circuit is based on a circuit described in another European patent application of the applicant with application number 99112906.5.

At first, the local power measurement block is described. The main idea is to divide the total display surface in many blocks $S_{ij}$, and then to integrate (add) the input video levels for all pixels in the block, which means for each pixel the video levels of the 3 colour components are added, thus obtaining a value $P_{ij}$:

$$P_{ij}=\Sigma(k\epsilon S_{ij})\ (R_k+G_k+B_k)$$

where k denotes all pixels belonging to $S_{ij}$.

Very bright small spots may be more objectionable with respect to thermal overheating than spots, having the same total power, but being somewhat larger. To handle this fact, it is suggested to square or even to cube the RGB pixel components, like in the following equations:

$$P_{ij}=\Sigma(k\epsilon S_{ij})\ (R_k^2+G_k^2+B_k^2)$$

$$P_{ij}=\Sigma(k\epsilon S_{ij})\ (R_k^3+G_k^3+B_k^3)$$

Figure 6:
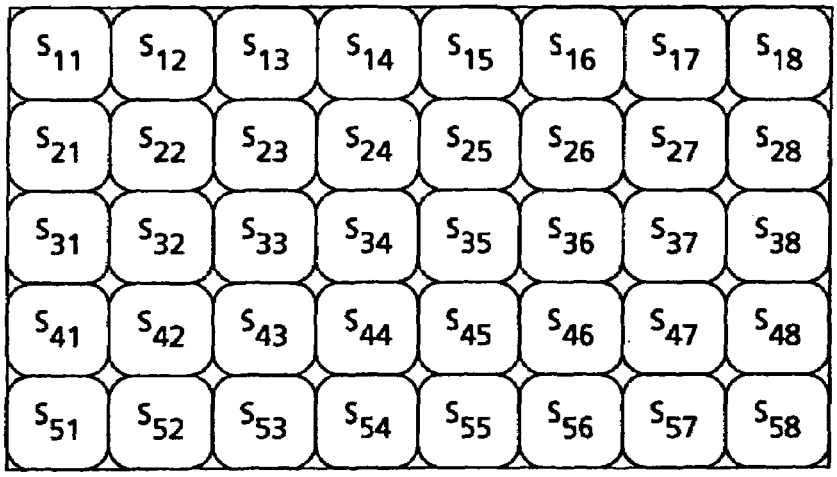
FIG. 6 shows a first partition of the display panel into blocks of pixels for the local temperature estimation.

In FIG. 6, a first example of the partition of the plasma display surface in blocks $S_{ij}$ is shown. For easiness of visualization, cells are presented with rounded edges, but in a practical implementation they will preferably be rectangular. In the shown example there is a total of 40 cells, but in an actual implementation the cell number might even be higher.

Figure 7:
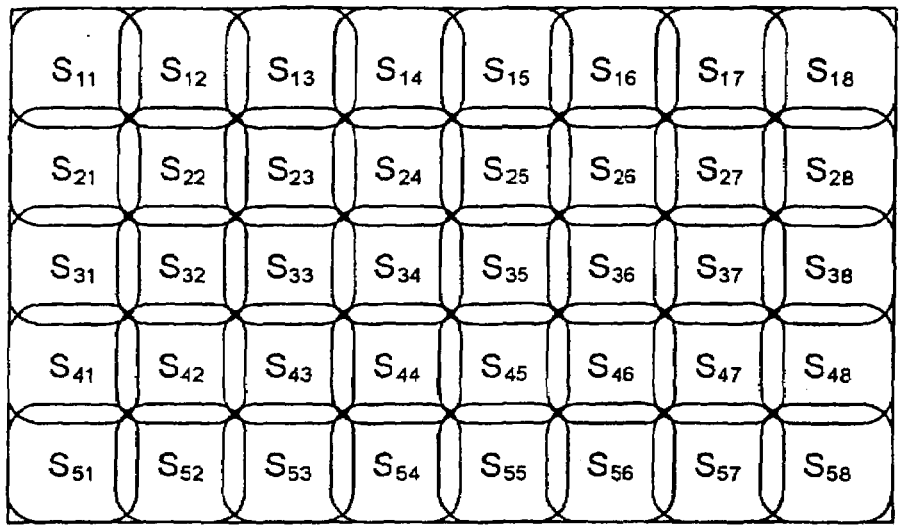
FIG. 7 shows a second partition of the display panel into blocks of pixels for the local temperature estimation with overlapping of blocks partly allowed.
Figure 8:
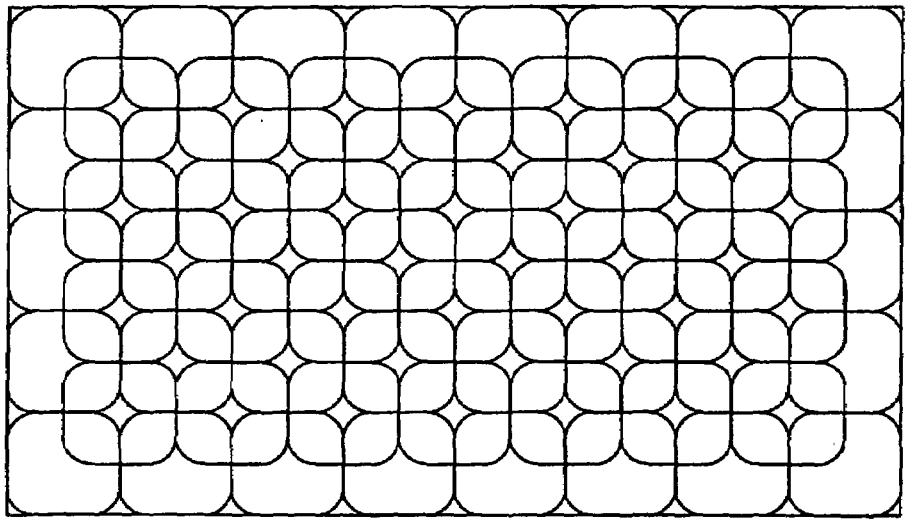
FIG. 8 shows a third partition of the display panel into blocks of pixels for the local temperature estimation with overlapping of blocks partly allowed.

The partition of the total display surface in blocks $S_{ij}$ can be improved, if overlapping of blocks is allowed, as e.g. shown in FIGS. 7 and 8.

Without overlapping of blocks, if a bright spot occurs, for instance exactly at the border of 2 blocks, it might not be detected. With substantial overlapping of cells, there will always be a cell that comprises any bright spot, regardless of the bright spot position.

Next, the local temperature estimation in block 19 is explained. If the power being dissipated has been evaluated, the next step is to build a model that allocates to every picture block a local temperature value. It is pointed out that many models are possible, some very simple, some quite complex, and that a compromise in complexity will have to be found. Here, some of the possible approaches are mentioned, keeping in mind that even the simplest approximation is better than having no protection at all.

The temperature of a given block is, in a first approximation, equal to the previous temperature estimation $T(i, j)_{t-1}$, plus the power being dissipated $a\cdot P(i, j)_t$ in the block in the current frame period, minus a dissipation term D corresponding to the heat being given to the environment per frame time:

$$T(i, j)_t=T(i, j)_{t-1}+a\cdot P(i, j)_t-D$$

This model can be improved by making the assumption that the heat dissipation is proportional to the actual temperature:

$$T(i, j)_t=T(i, j)_{t-1}+a\cdot P(i, j)_t-b\cdot T(i, j)_{t-1}$$

Furthermore, thermal dispersion to the near-by blocks can also be considered:

$$T(i, j)_t=T(i, j)_{t-1}+a\cdot P(i, j)_t-b\cdot T(i, j)_{t-1}-$$

$$c\cdot[T(i-1, j)_{t-1}-T(i, j)_{t-1}]-$$

$$c\cdot[T(i+1, j)_{t-1}-T(i, j)_{t-1}]-$$

$$c\cdot[T(i, j-1)_{t-1}-T(i, j)_{t-1}]-$$

$$c\cdot[T(i, j+1)_{t-1}-T(i, j)_{t-1}]-$$

The newly added terms can be either negative (if the near-by blocks are cooler) or positive (if the near-by blocks are hotter). Finally, for a last further refinement, diagonal thermal dispersion might also be considered by adding 4 further terms, but the complexity of the shown model should be enough for all practical purposes.

The above model also deals with the border effect. Blocks at the border, or at the corners will have less dissipation possibilities, due to the fact that they have less near-by blocks. They may overheat quicker, for the same power being dissipated, but this should be correctly detected by the last here presented model.

Next, the maximum local temperature determination in block 20 is explained. In principle to find the maximum local temperature MT, it is required to evaluate, in the current example, the 40 $P_{ij}$ values (40=5 rows*8 columns) in block 18 and the corresponding 40 $T_{ij}$ values in block 19, and then finding the maximum in block 20. This requires quite a number of operations per frame, with a large number of video integrators working in parallel.

Thermal heating is however a very slow process, and so the following approximation might be used:

1. For every frame the dissipation on a single picture block is calculated, i.e., power dissipation in every block is evaluated only once for every group of 40 frames (in this example).
2. For the selected picture block the local temperature is computed in block 19 using the following expression:

$$T(i,j)_t = T(i,j)_{t-40} + a \cdot P(i,j)_t - b \cdot T(i,j)_{t-40} -$$

$$c \cdot [T(i-1,j)_{t-40} - T(i,j)_{t-40}] -$$

$$c \cdot [T(i+1,j)_{t-40} - T(i,j)_{t-40}] -$$

$$c \cdot [T(i,j-1)_{t-40} - T(i,j)_{t-40}] -$$

$$c \cdot [T(i,j+1)_{t-40} - T(i,j)_{t-40}] -$$

Here, the index t-40 means that the corresponding temperature value is an old value being calculated before, at maximum 40 frames before. Of course, the power dissipation term $a \cdot P(i,j)_t$ ignores all the power dissipations coming from the 40 frames between two temperature estimations for the same block and this is a drawback of the model. However it has been proofed that in practice this error is for TV pictures acceptable. More expenditure for the temperature estimation can be reasonable for PDPs, which are used as a computer monitor where most pictures being displayed are still pictures.

3. Update the MT value (maximum temperature) in block 20. In order to do this it is required to know whether the block number $(i,j)_t$ for the MT value being determined, corresponds to the block $(i,j)max_{t-1}$ where the previous MT value ($MTt_1$) was found.

If the block number is the same ($(i,j)_t = (i,j)max_{t-1}$):
Then $MTt = T_{ij}$ If the block number is not the same ($(i,j)_t$ ? $(i,j)max_{t-1}$):
if ($T_{ij} > MT_{t-1}$)
then $MT_t = T_{ij}$
and $(i,j)maxt = (i,j)_t$
else
$MT_t = MT_{t-1}$.

The above-mentioned algorithm is performed in block 20 of FIG. 5. This approximation reduces the evaluation complexity by a factor of 40.

Figure 9:
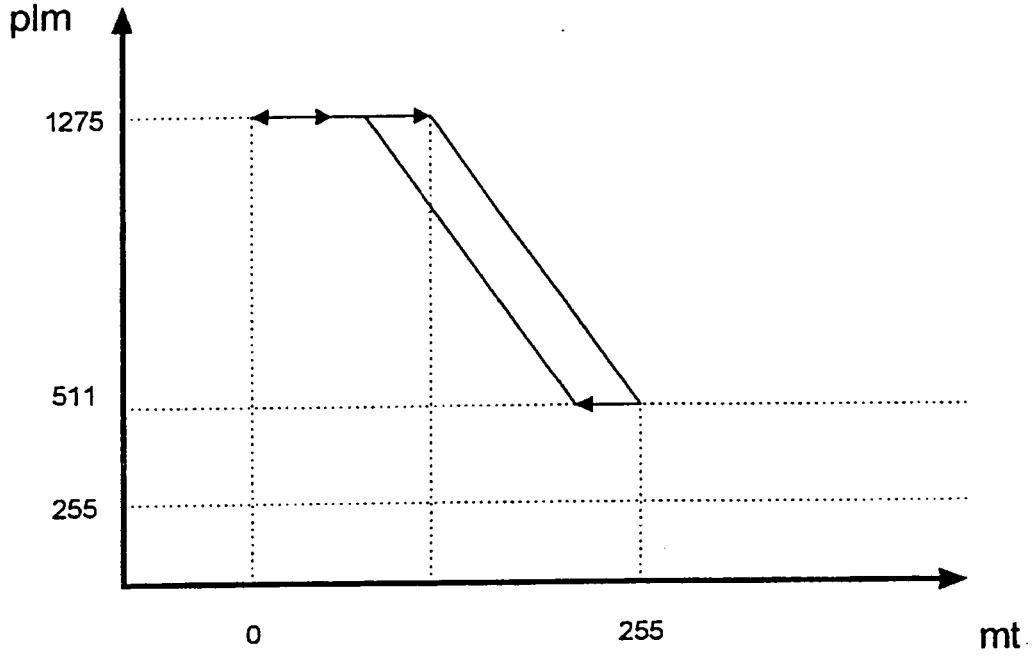
FIG. 9 shows a hysteresis curve used for maximum power level limit selection.

FIG. 9 depicts the function of the maximum power level selection circuit 21. It shows the maximum allowed power level (plm) as a function of the estimated maximum panel local temperature (mt).

For low maximum local temperature values, no reductions in peak white level are required. For higher values, the maximum peak white level is gradually reduced. At the limit, in the figure, PWEF has been reduced from the original value of 5 to approximately 2 (full white corresponds to a power level of 255).

Some hysteresis, like the depicted hysteresis curve is built-in, in order to avoid small amplitude oscillations, mostly originating in errors of measurement, or in the displayed video noise.

The temperature estimation model is a model that reacts slowly to modifications in dissipated power. This is correct, because the panel temperature also reacts slowly to power being dissipated. Due to this slow reaction of the estimated panel temperature, it is sufficient for most applications, as explained above, that also the protection circuit reacts slowly, which has the additional advantage that its operation will not be perceived by the human viewer.

Last, the function of the power level limit block 22 will be explained. This circuit is a simple limiter that actuates only when dangerous local overheating has been detected. It does not change the function of the peak white enhancement circuit. It only limits the power level range available to the peak white enhancement control circuit. E.g., if the maximum power level value output from the block 21 is 765, then only the first 34 power level modes of EP 99101977.9 are selectable for PWEF control. The rest of the power level modes are forbidden.

The described circuit and algorithm performs a protection function, which means that, for most video pictures, it will have no effect, and only in case of a static bright spot, the peak white enhancement factor will be attenuated.

It can also be used for CRT based displays, where local overheating may cause local doming problems. Local doming, is a colour distortion of the picture, due to the local deformation of the CRT's mask, which is induced by local overheating of the tube colour mask.

It is also possible to have dynamic peak white control without having a protection circuit. Picture quality will however not be the same, because the dynamic peak white control will use a restricted range for the PWEF, in order to avoid unacceptable local thermal overheating.

What is claimed is:

1. Method for power level control in a display device having a plurality of display elements corresponding to the pixels of a picture, wherein a power level mode selection process is used for increasing the peak white enhancement factor of the display, in which the power value of a video picture is measured and a corresponding power level mode is selected for controlling the display contrast, wherein a picture is divided in a number of blocks, wherein in each block the video levels or values derived from the video levels of the colour components of the pixels are summed up in order to determine the local power values for the picture, wherein a local temperature estimation is performed for the corresponding blocks of the display based on said local power values and the previously estimated local temperature values according to the formula:

$$T(i,j)_t = T(i,j)_{t-1} + a \cdot P(i,j)_t - D$$

where $T(i,j)_t$ is the new estimated local temperature of a block, where $T(i,j)_{t-1}$ is the previous estimated local temperature of a block, where $a \cdot P(i,j)_t$ is the power being dissipated in the block and D is the power dissipation corresponding to the heat being given to the environment, wherein in the estimated local temperature values the maximum local temperature in the display is selected, wherein a further step of maximum power level limit determination is performed based on the maximum local temperature, and wherein the power level limit is used to restrict the range of selectable power level modes in the power level mode selection process to power level modes having a power level below or equal to said power level limit.

2. Method according to claim 1, wherein for local temperature estimation of a block, the power dissipation not only of the local block but also of a number of neighbouring blocks is taken into account.

3. Method according to claim 1, wherein the maximum local temperature determination for the display is performed once in a number of video frames.

4. Method according to claim 3, wherein the steps of local power value determination and local temperature estimation are performed only for one or more selected blocks of the whole picture within a frame period.

5. Method according to claim 3, wherein a picture is divided in 40 blocks and the maximum local temperature determination is performed once within 40 frames.

6. Method according to claim 1, wherein the switching between maximum allowed power level limits corresponding to the determined maximum local temperature is controlled with a power level mode against picture power curve that falls if the picture power is increasing and that rises if the picture power is decreasing, and with a delay between falling and rising, respectively rising and falling if the change direction of the picture power value changes.

7. Apparatus having included a power level determination and selection unit, and a local power determination unit, wherein for a picture that is divided in a number of blocks, per block the video levels or values derived from the video levels of the colour components of the pixels are summed up in order to determine the local power values for the picture, wherein, said apparatus further includes a local temperature estimator, that performs a local temperature estimation per block of the display based on said local power values and the previously estimated power values, according to the formula:

$$T(i,j)_t = T(i,j)_{t-1} + a \cdot P(i,j)_t - D$$

where $T(i,j)_t$ is the new estimated local temperature of a block, where $T(i,j)_{t-1}$ is the previous estimated local temperature of a block, where $a \cdot P(i,j)_t$ is the power being dissipated in the block and D is the power dissipation corresponding to the heat being given to the environment, said apparatus further includes a maximum local temperature selector that selects the maximum local temperature from the estimated local temperatures, a maximum power level limit selector that assigns a maximum power level limit to the selected maximum local temperature, and a power level limiter, wherein the power level limiter restricts the range of selectable power level modes in the power level mode selector to power level modes having a power level below or equal to said selected maximum power level limit.

8. Apparatus according to claim 7, wherein it is integrated in a plasma display device.

* * * * *